US007854562B2

(12) United States Patent
Peterson et al.

(10) Patent No.: US 7,854,562 B2
(45) Date of Patent: Dec. 21, 2010

(54) INTERNAL FEED MANUAL PAINT BRUSH

(75) Inventors: Craig Peterson, Carver, MN (US); Ross Rossner, St. Michael, MN (US); Allen Alden Caldwell, Shakopee, MN (US); Robert H. Bruno, Avon, CT (US); Joseph Toro, Stratford, CT (US)

(73) Assignee: Wagner Spray Tech Corporation, Plymouth, MN (US)

( * ) Notice: Subject to any disclaimer, the term of this patent is extended or adjusted under 35 U.S.C. 154(b) by 1046 days.

(21) Appl. No.: 11/425,264

(22) Filed: Jun. 20, 2006

(65) Prior Publication Data

US 2007/0292197 A1 Dec. 20, 2007

(51) Int. Cl.
*B43M 11/06* (2006.01)
*A47L 13/22* (2006.01)

(52) U.S. Cl. ..... 401/186; 401/183; 401/270; 401/287; 401/286

(58) Field of Classification Search ..... 401/183–186, 401/270, 271, 278, 282, 285–289
See application file for complete search history.

(56) References Cited

U.S. PATENT DOCUMENTS

| | | | |
|---|---|---|---|
| 141,522 | A | 8/1873 | Thompson |
| 176,044 | A | 4/1876 | Parks |
| 451,179 | A | 4/1891 | Ware |
| 1,030,440 | A | 6/1912 | Waterman |
| 1,038,376 | A | 9/1912 | Jaeschke |
| 1,206,661 | A | 11/1916 | Booth |
| 1,258,677 | A | 3/1918 | Haskell |
| 1,412,958 | A | 4/1922 | Pearlmutter |
| 1,428,399 | A | 9/1922 | Schilling |
| 1,505,442 | A | 8/1924 | Stephens |
| 1,943,202 | A | 1/1934 | Charles |
| 2,198,773 | A | 4/1940 | Hollenbeck |
| 2,260,100 | A | 10/1941 | Deitrich et al. |
| 2,505,441 | A | 4/1950 | Taverner |
| 2,632,904 | A | 3/1953 | Halecky |
| 2,743,042 | A | 4/1956 | Burgin |
| 2,758,755 | A | 8/1956 | Schafler |
| 2,922,178 | A | 1/1960 | Kelly |

(Continued)

FOREIGN PATENT DOCUMENTS

| | | |
|---|---|---|
| CN | 2058569 U | 6/1990 |

(Continued)

OTHER PUBLICATIONS

English Translation Text of First Office Action, Chinese Patent Application No. 200710112551.7, dated Nov. 6, 2009.

*Primary Examiner*—David J Walczak
(74) *Attorney, Agent, or Firm*—Faegre & Benson LLP

(57) ABSTRACT

A manually operated internally fed paint brush having a resilient handle forming a refillable paint reservoir and a brush head with a fluid delivery path connecting the reservoir to the brush head via a siphon tube having an inlet positioned at a lowermost region of the reservoir when the paint brush is generally horizontal. A combined valve and O-ring seals an outlet of the siphon tube and selectively opens in response to compression of the reservoir. A latching mechanism retains the brush head to the handle. A trough having a spout is provided for filling the paint brush.

6 Claims, 14 Drawing Sheets

U.S. PATENT DOCUMENTS

| | | | | | |
|---|---|---|---|---|---|
| 2,943,602 | A | * | 7/1960 | Rundle | 119/650 |
| 3,390,940 | A | * | 7/1968 | Schwartzman | 401/186 |
| 3,485,563 | A | * | 12/1969 | Chennell | 401/183 |
| 3,658,432 | A | * | 4/1972 | Lanusse | 401/219 |
| 3,938,897 | A | | 2/1976 | Craig | |
| 4,008,853 | A | | 2/1977 | Tregillus | |
| 4,167,349 | A | * | 9/1979 | Testa | 401/144 |
| 4,341,239 | A | | 7/1982 | Atkinson | |
| 4,434,810 | A | | 3/1984 | Atkinson | |
| 4,535,818 | A | | 8/1985 | Duncan et al. | |
| 4,535,819 | A | | 8/1985 | Atkinson et al. | |
| 4,566,493 | A | | 1/1986 | Edwards et al. | |
| 4,612,960 | A | | 9/1986 | Edwards et al. | |
| 4,827,973 | A | | 5/1989 | Boehmer | |
| 4,951,701 | A | | 8/1990 | Boehmer | |
| 4,986,310 | A | | 1/1991 | Bailey et al. | |
| 5,010,925 | A | | 4/1991 | Atkinson et al. | |
| D318,803 | S | | 8/1991 | Bekius et al. | |
| 5,054,947 | A | | 10/1991 | Frank et al. | |
| 5,099,878 | A | | 3/1992 | Boehmer | |
| 5,129,426 | A | | 7/1992 | Boehmer | |
| 5,139,357 | A | | 8/1992 | Reents | |
| 5,186,559 | A | | 2/1993 | Fu | |
| 5,186,653 | A | | 2/1993 | Robert | |
| 5,249,598 | A | | 10/1993 | Schmidt | |
| 5,261,459 | A | | 11/1993 | Atkinson et al. | |
| 5,269,763 | A | | 12/1993 | Boehmer et al. | |
| 5,301,707 | A | | 4/1994 | Hofsteenge | |
| 5,388,925 | A | | 2/1995 | Wilcox et al. | |
| 5,454,573 | A | | 10/1995 | Nijland | |
| 5,474,099 | A | | 12/1995 | Boehmer et al. | |
| 5,839,614 | A | | 11/1998 | Brown | |
| 5,887,753 | A | * | 3/1999 | Poolman | 222/1 |
| 5,904,434 | A | | 5/1999 | Bekius et al. | |
| 5,950,878 | A | | 9/1999 | Wade et al. | |
| 6,065,642 | A | | 5/2000 | Brown | |
| 6,112,951 | A | | 9/2000 | Mueller | |
| 6,145,151 | A | | 11/2000 | Herron et al. | |
| 6,161,978 | A | | 12/2000 | Dovellos | |
| 6,402,410 | B1 | | 6/2002 | Hall et al. | |
| 6,405,901 | B1 | | 6/2002 | Schantz et al. | |
| 6,439,381 | B1 | | 8/2002 | Alvarez | |
| 6,505,986 | B1 | | 1/2003 | Oder | |
| D470,914 | S | | 2/2003 | Frank et al. | |
| D472,304 | S | | 3/2003 | Fageroos et al. | |
| 6,543,652 | B1 | | 4/2003 | Kelder et al. | |
| 6,769,577 | B1 | | 8/2004 | Feierabend | |
| 6,805,512 | B2 | | 10/2004 | King | |
| 7,044,334 | B2 | | 5/2006 | Mita et al. | |
| 2003/0189067 | A1 | | 10/2003 | Stull et al. | |
| 2005/0066996 | A1 | | 3/2005 | France et al. | |
| 2006/0086393 | A1 | | 4/2006 | Bailey | |

FOREIGN PATENT DOCUMENTS

| | | | |
|---|---|---|---|
| CN | 2177376 | Y | 9/1994 |
| CN | 2751641 | Y | 1/2006 |

* cited by examiner

INTERNAL FEED MANUAL PAINT BRUSH

BACKGROUND OF THE INVENTION

The present invention relates to the field of internal feed paint applicators, particularly brushes. In the past, some applicators, such as those related to U.S. Pat. No. 5,904,434 and U.S. Pat. No. 5,139,357, have included two elements connected by a hose. One element was a pump and paint reservoir and the other element was a hand held paint brush, with paint delivered to the brush through the hose. Another type was a conventionally styled paint applicator head that was attachable to a bottle containing paint, such as shown in U.S. Pat. No. 6,439,381. To use such a manual delivery prior art device, the bottle was required to be tipped until the applicator was below the level of the bottle, at which time the bottle was squeezed, and gravity delivered the paint to the applicator.

Another type of prior art paint applicator is illustrated in U.S. Pat. No. 6,145,151. In this patent a non-internal feed paint brush is described as having an asymmetric brush handle.

BRIEF SUMMARY OF THE INVENTION

In one aspect, the present invention includes a paint reservoir that does not need to be tipped to replenish or reload the brush head with paint. An internal siphon tube is positioned to draw paint from a lowermost region of the paint reservoir in the handle with the brush in a generally horizontal position, i.e., with the brush head positioned generally horizontal to the handle reservoir. While in this position, a user need merely squeeze the handle to deliver paint from the reservoir to the brush head, without repositioning the brush in the hand of the user.

A further aspect of the present invention is a vacuum breaker located in a fill cap to prevent buildup of vacuum in the reservoir as the paint is used up.

Additionally, the handle (formed by the reservoir) is preferably non-symmetric, encouraging a user to grasp the paint brush in a manner recommended by professional painters with the handle extending back between the thumb and forefinger and above a user's hand.

In another aspect, the present invention may include a system that can accommodate a plurality of brush heads of different widths, each connectable to the same handle and paint reservoir, resulting in commonality of parts and economies of scale in the manufacture of products according to the present invention.

A further aspect of the present invention may include an offset position for wider brush heads.

In still another aspect, the present invention includes a latching mechanism for securely retaining the brush head to the handle, while at the same time allowing easy removal and installation without requiring the use of tools.

A paint loading device is provided to load the handle reservoir, with the paint loading device being in the form of a gravy-boat-like trough with a spout at one end for convenience in filling the reservoir.

DETAILED DESCRIPTION OF THE INVENTION

Figure 1:
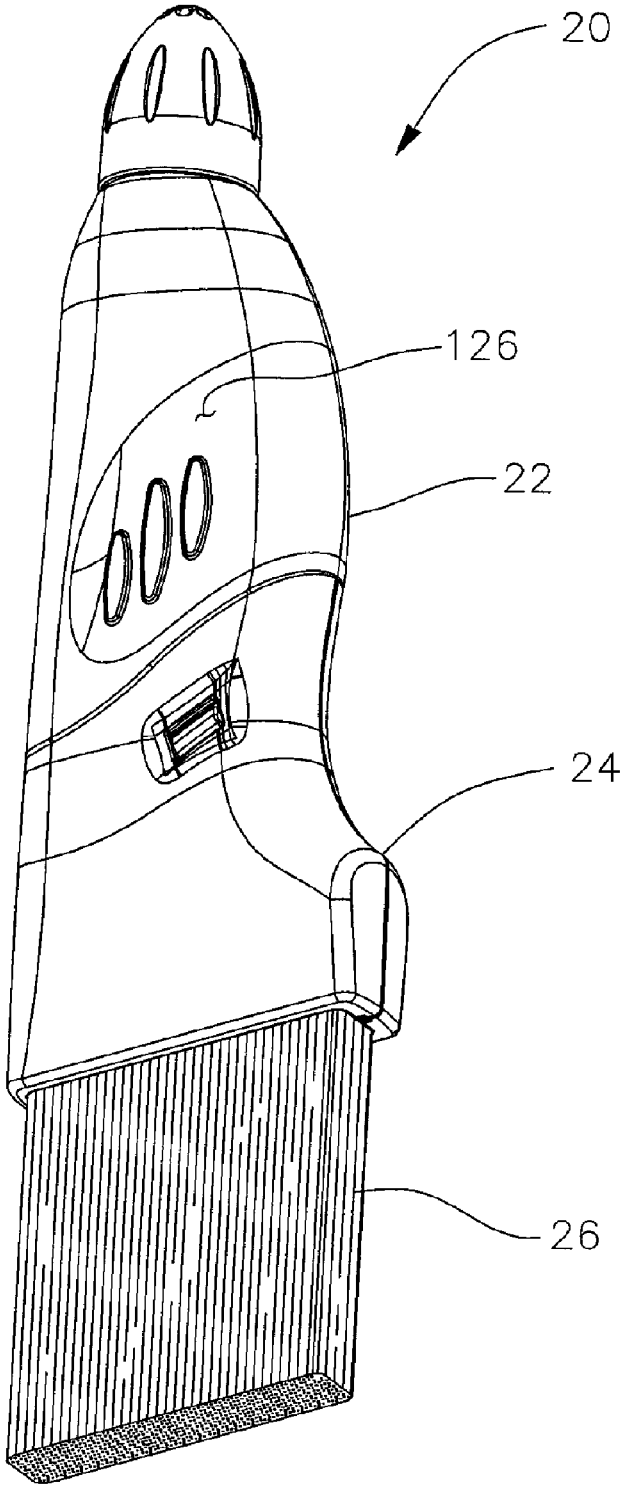
FIG. 1 is a perspective view of a paint brush according to the present invention.
Figure 2:
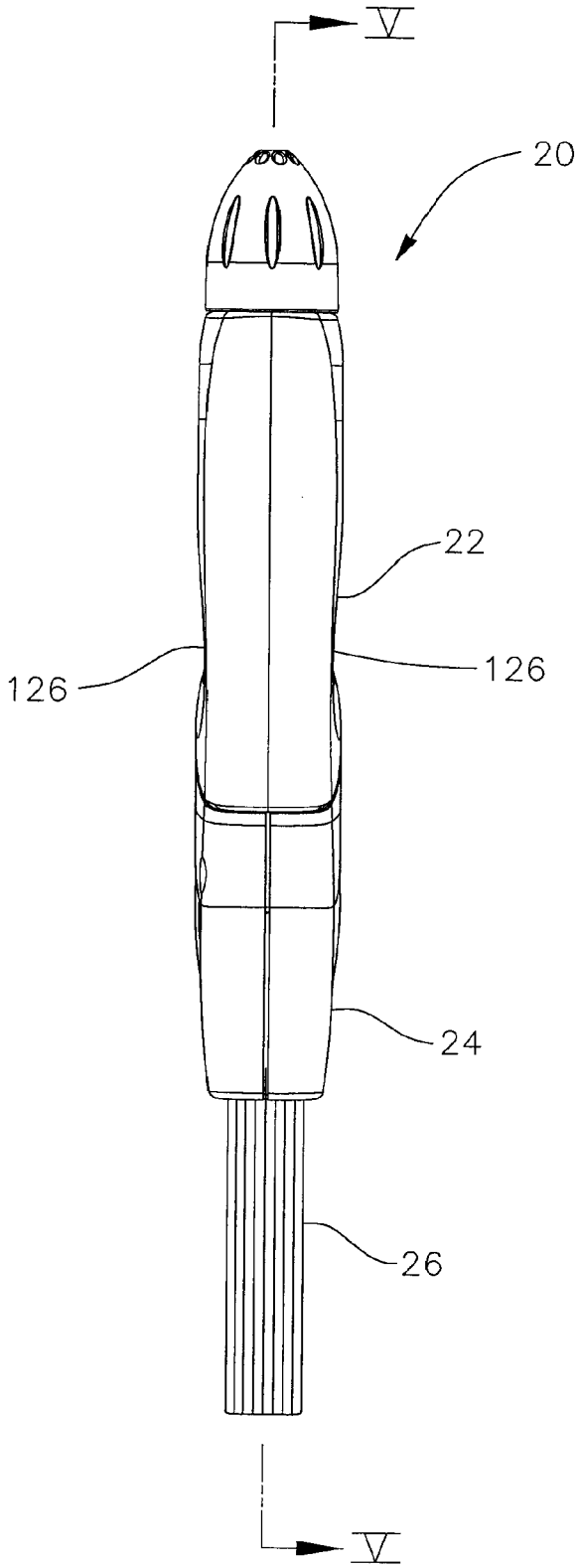
FIG. 2 is an edge view of the paint brush of FIG. 1.
Figure 3:
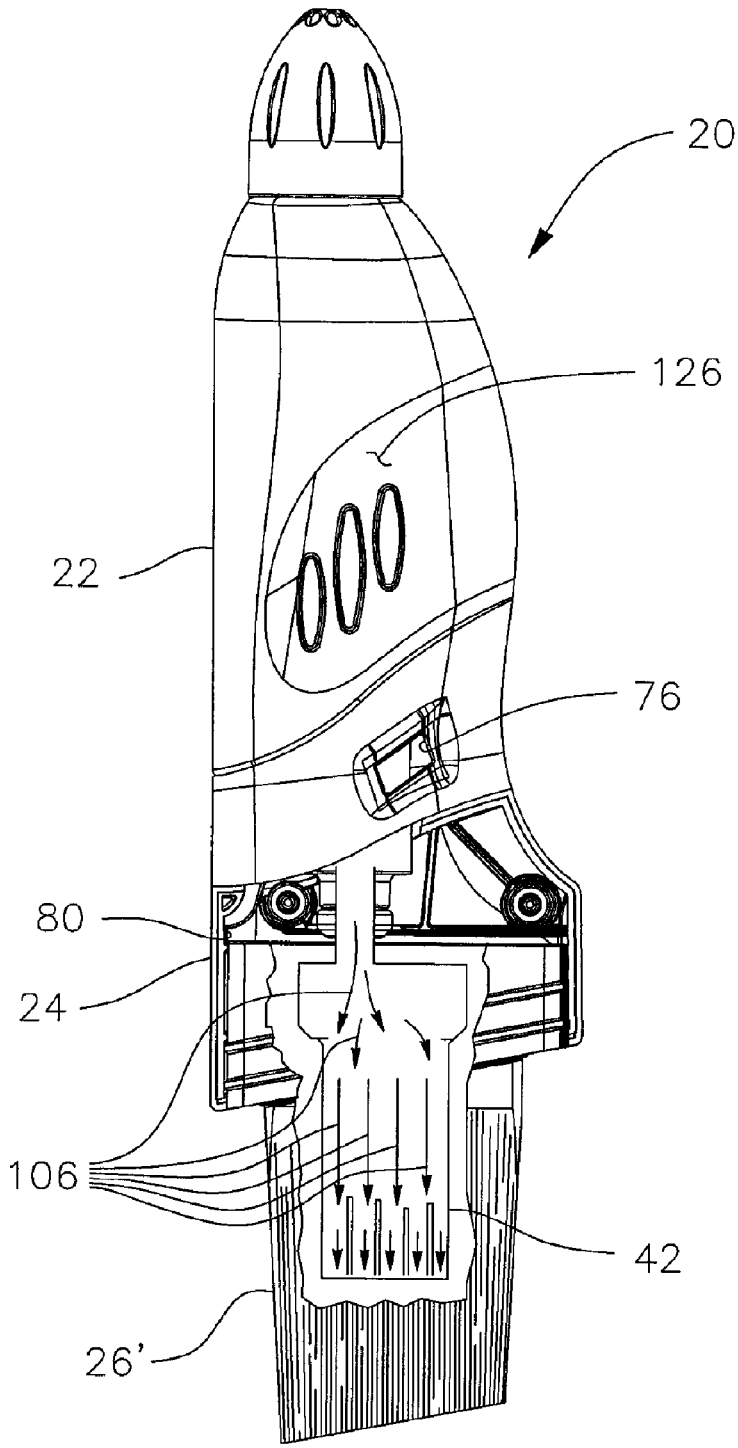
FIG. 3 is a partially cut away side view of the paint brush of FIG. 1.

Referring now to the Figures, and most particularly to FIGS. 1-3, a paint brush 20 useful in the practice of the present invention may be seen. Brush 20 includes a handle 22 and a brush head 24. Brush head 24 has a plurality of bristles 26 which may be in the form of a straight or conventional pattern as shown in FIG. 1 or the bristles may be arranged in a tapered or sash brush configuration 26' or pattern as shown in FIG. 3.

Figure 4:
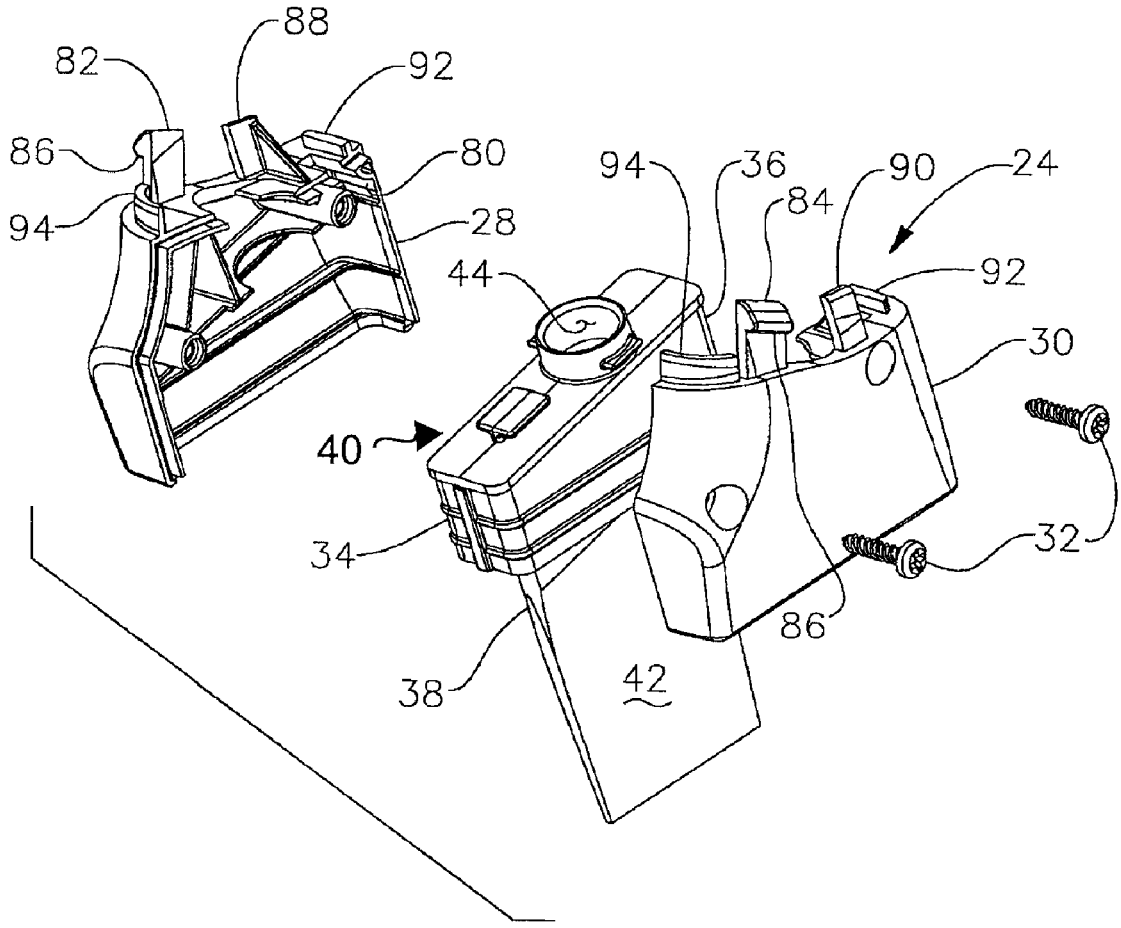
FIG. 4 is an exploded view of a paint brush head according to the present invention, but with bristles omitted to illustrate certain features of the brush head.
Figure 5:
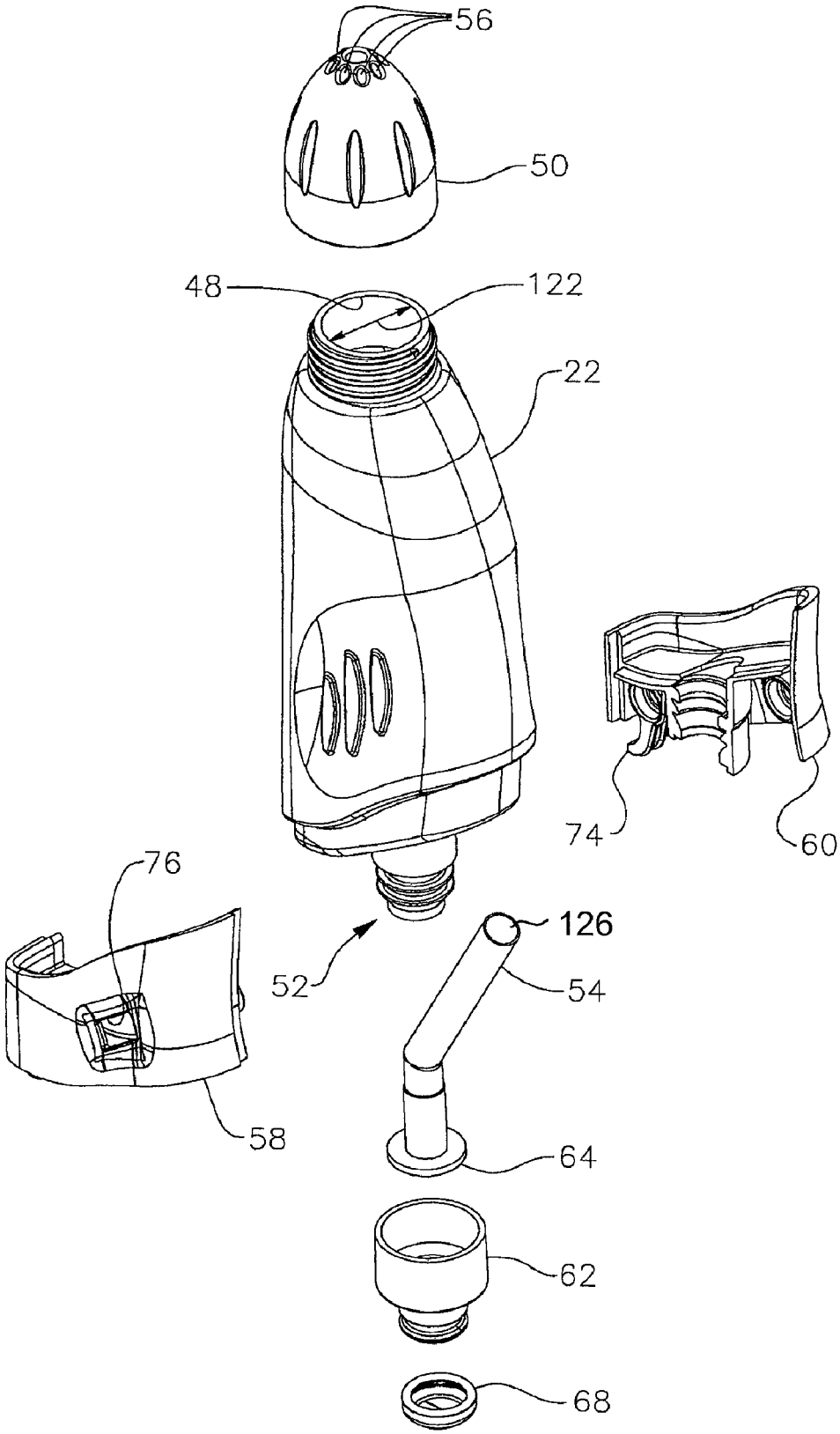
FIG. 5 is an exploded view of the handle portion of the paint brush of the present invention.
Figure 6:
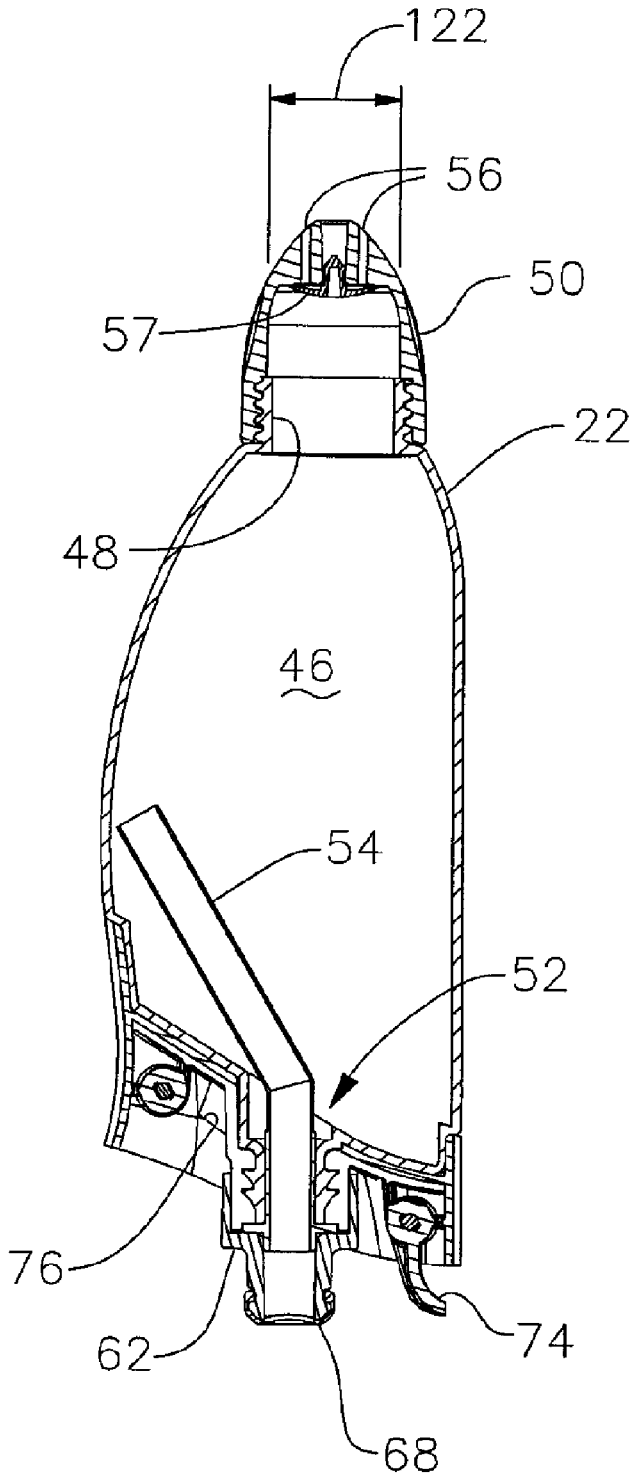
FIG. 6 is a section view of the handle portion of the paint brush of the present invention taken along line V-V of FIG. 2.
Figure 7:
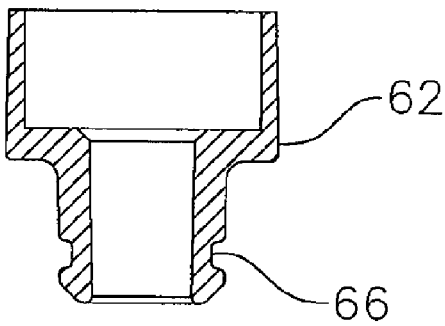
FIG. 7 is an enlarged section view of an adapter useful in the practice of the present invention.

Referring now also to FIG. 4, the brush head 24 may have a left case half 28 and a right case half 30 attached together by screws 32 and surrounding a bristle head assembly 34. The bristle head assembly 34 may have a metal ferrule 36 securing the bristles or filaments of the brush head to a distributor assembly 38, which in turn may include a body 40 and distributor 42. The distributor 42 is a flat, liquid impermeable fabric of nylon or other similar woven material formed into a sleeve configuration and in fluid communication with the body 40 such that fluid delivered to an aperture 44 in the body is free to flow through the sleeve of the distributor 42 for delivery to the bristles 26. Desirable characteristic features of the distributor 42 are that it is relatively flat and highly flexible and may even be sufficiently limber to be non-self supporting, to avoid or minimize affecting the leveling action of the filaments 26 as paint is applied to a surface by the brush 20. The filaments or bristles 26 may be secured within the assembly 34 by a conventional epoxy material. The parts, materials and construction of the assembly 34 may be the same or similar to that shown and described in U.S. Pat. No. 5,904,434, Internal Feed Paintbrush, the entire contents of which are hereby expressly incorporated by reference.

As used herein the word "paint" is to be understood to refer to paint and similar architectural coating materials, including but not limited to paints (both water and mineral spirit soluble) and stains.

Referring now also to FIGS. 5-9, various details of the handle 22 may be seen. Handle 22 includes a paint reservoir 46 having a first opening 48 closed by a cap 50 and a second opening 52 which receives a siphon tube 54. Cap 50 has a plurality of vent apertures 56 closed by a conventional umbrella valve 57. Valve 57 is a vacuum breaker valve which opens to relieve vacuum in reservoir 46 as it is depleted of paint during operation. Cap 50 may be threadably received on the handle 22 to selectively open and close the first opening 48 of the reservoir 46, as desired. A pair of handle case halves 58 and 60 may be attached to the handle in the region surrounding the second opening 52 and the projection of the siphon tube 54 out of the reservoir 46. A pair of conventional screws (not shown) may be used to secure halves 58 and 60 together. A step down adapter 62 may be secured to a flange 64 on the siphon tube 54 and case halves 58, 60 by a conventional solvent bond. Adapter 62 may have a circumferential groove 66 to receive and retain a seal 68 in the form of a combined valve and O-ring.

The handle case halves 58 and 60 may be secured to the second opening 52 of the reservoir 46 by a plurality of rings 70 on the opening 52 and mating rings 72 on the case halves 58 and 60. It is to be understood that the reservoir 4 forming the main part of the handle 22 is formed of a relatively flexible polymer, such as polyethylene, while the handle case halves 58 and 60 may be formed of a relatively more rigid polymer. The brush head case halves 28 and 30 may also be formed of a relatively more rigid polymer. As used herein the reservoir and handle may be referred to interchangeably, however, the handle 22 may optionally be considered to also include parts other than the reservoir 46, for example, the handle case halves 58, 60, the siphon tube 54 and the step down adapter 62.

The handle case formed by case halves 58 and 60 may have a hook 74 formed integrally therewith and extending therefrom. Each of handle case halves 58, 60 also has a rectangular aperture 76, 78. Hook 74 is received in a recess 80 formed in the brush head case made up of halves 28 and 30. Ears 82 and 84 may be received, respectively by apertures 76 and 78 when the brush head 24 is attached to the handle 22. Each of ears 82, 84 has a lip 86 to retain the brush head 24 against inadvertent separation from the handle 22. When it is desired to remove the brush head 24 from the handle, ears 82 and 84 are depressed sufficiently such that lips 86 clear the interior edge of the respective apertures 76, 78, allowing the brush head 24 to be pivoted on hook 74 away from the handle 22 until the hook 74 withdraws from the recess 80, allowing full separation of the brush head 24 from the handle 22. A pair of side guide posts 88, 90 and a pair of end walls 92, 94 assist the user in guiding the brush head 24 into alignment with the handle case 58, 60 when the brush head 24 is being installed on the handle 22. Additionally, the posts 88, 90 and end walls 92, 94 maintain alignment and rigidity between the brush head 24 and the handle 22 when assembled together. The ears 82, 84 and apertures 76, 78 form a latching mechanism for releasably retaining the brush head 24 to the handle 22. The latching mechanism may optionally also include hook 74 and recess 80, and may further optionally include posts 88, 90 and end walls 92, 94 with corresponding mating surfaces in the handle case halves 58, 60.

Figure 8:
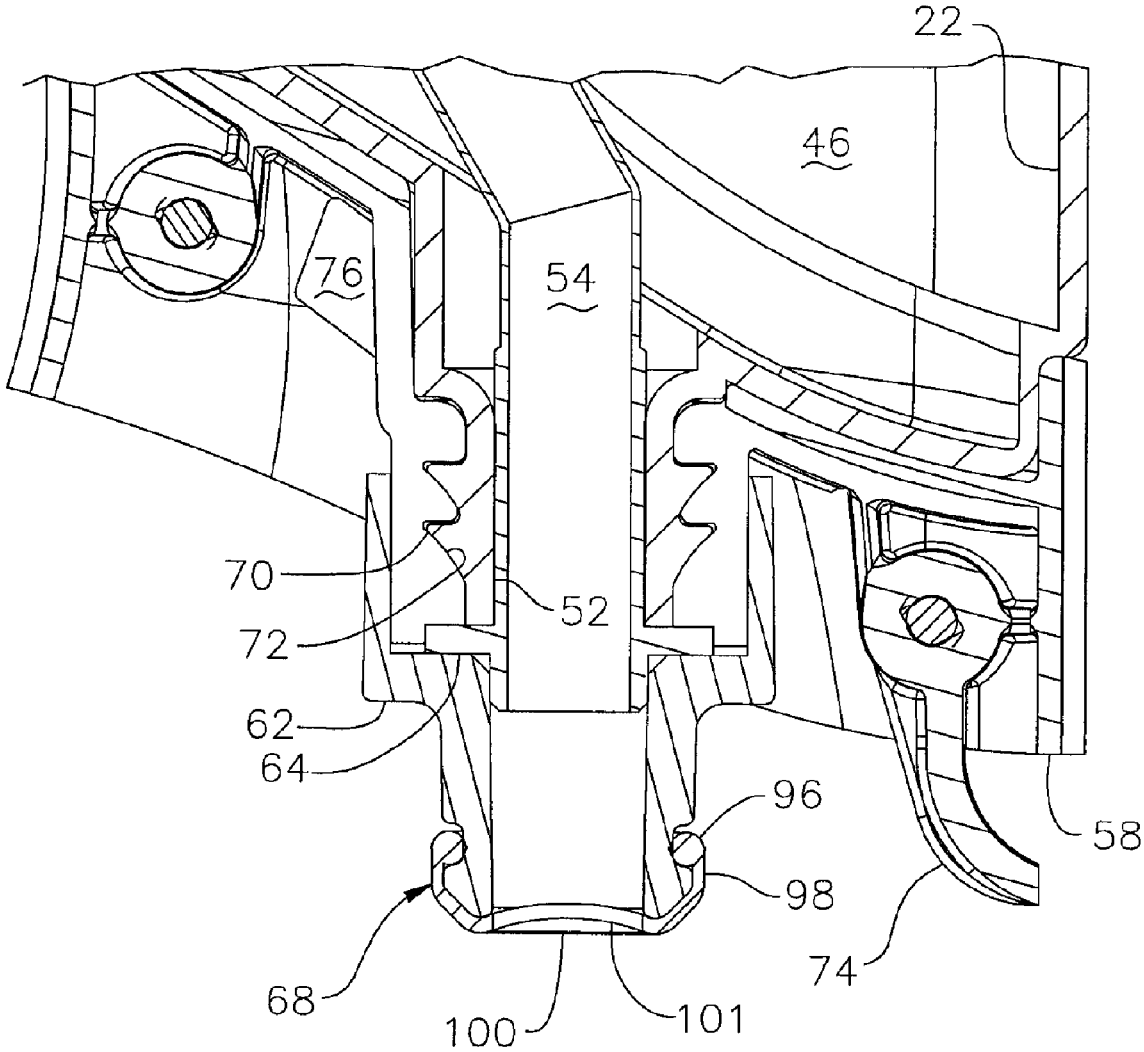
FIG. 8 is an enlarged fragmentary view of a portion of FIG. 6.
Figure 9:
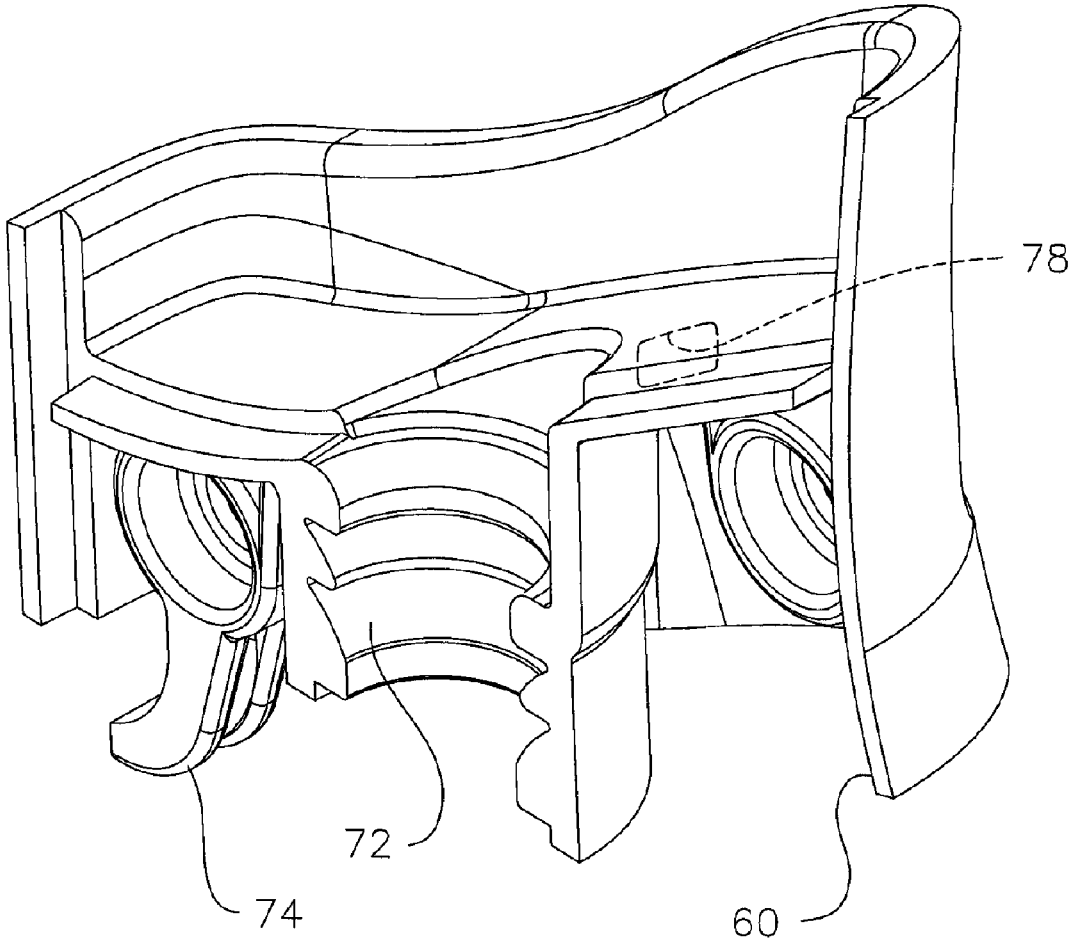
FIG. 9 is an enlarged perspective view of a case half from FIG. 5.
Figure 12:
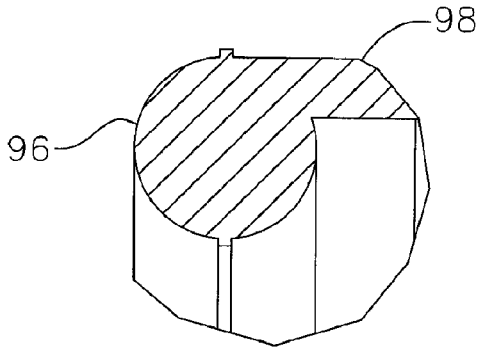
FIG. 12 is an enlarged view of detail XII of FIG. 11.
Figure 10:
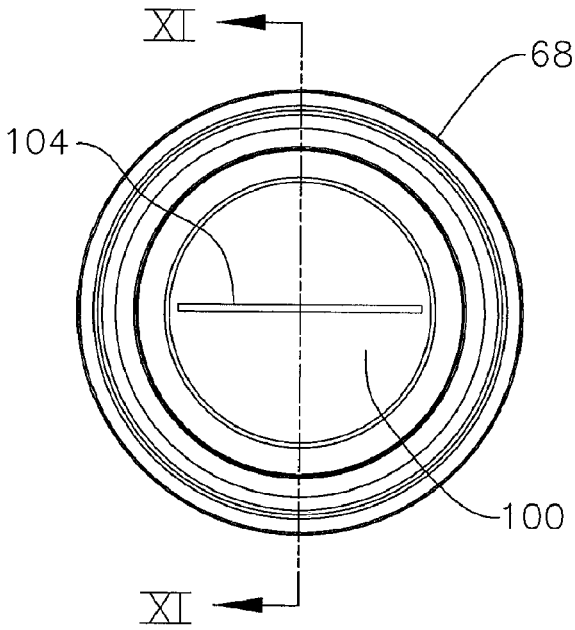
FIG. 10 is a plan view of a combined valve and O-ring useful in the practice of the present invention.
Figure 11:
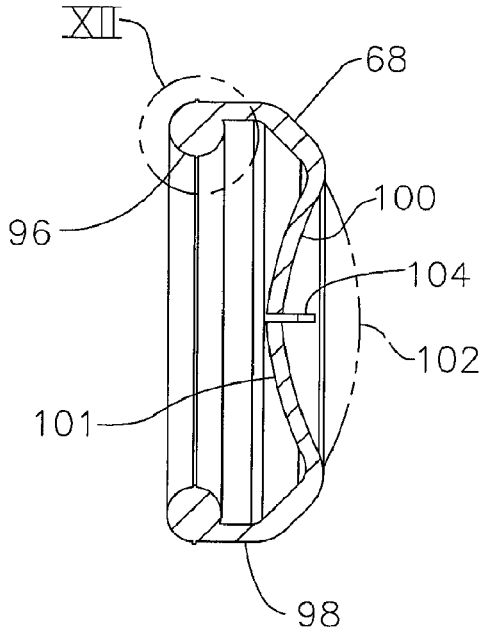
FIG. 11 is a section view taken along line XI-XI of FIG. 10.
Figure 13:
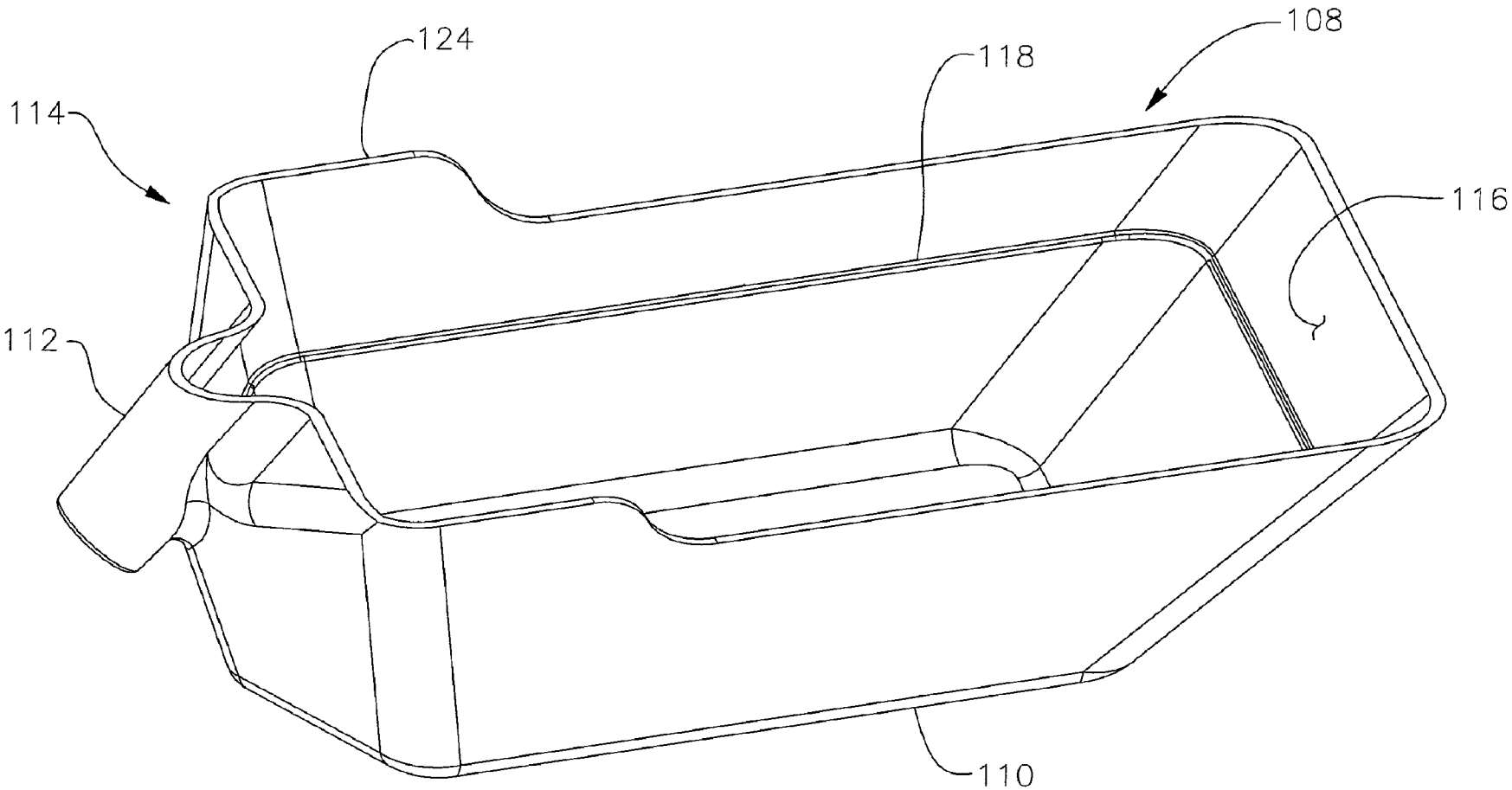
FIG. 13 is a perspective view of a trough useful to fill the paint brush of the present invention.
Figure 14:
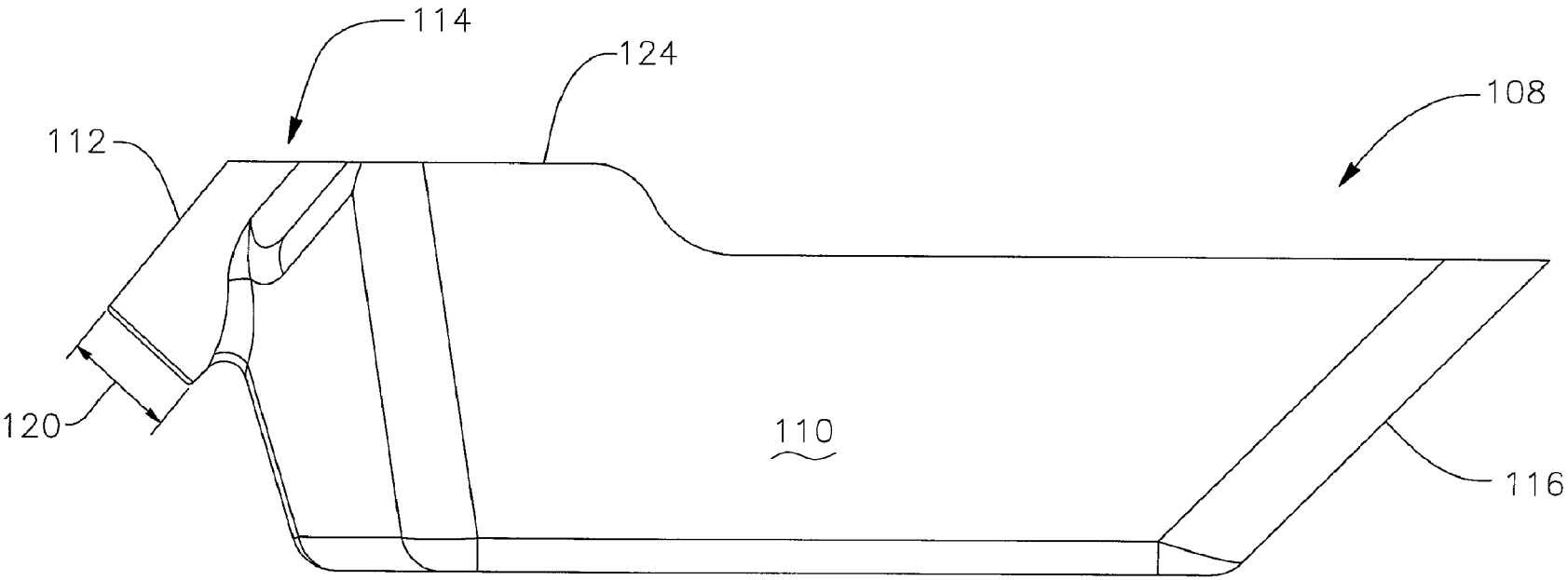
FIG. 14 is a side elevation view of the trough of FIG. 13.
Figure 15:
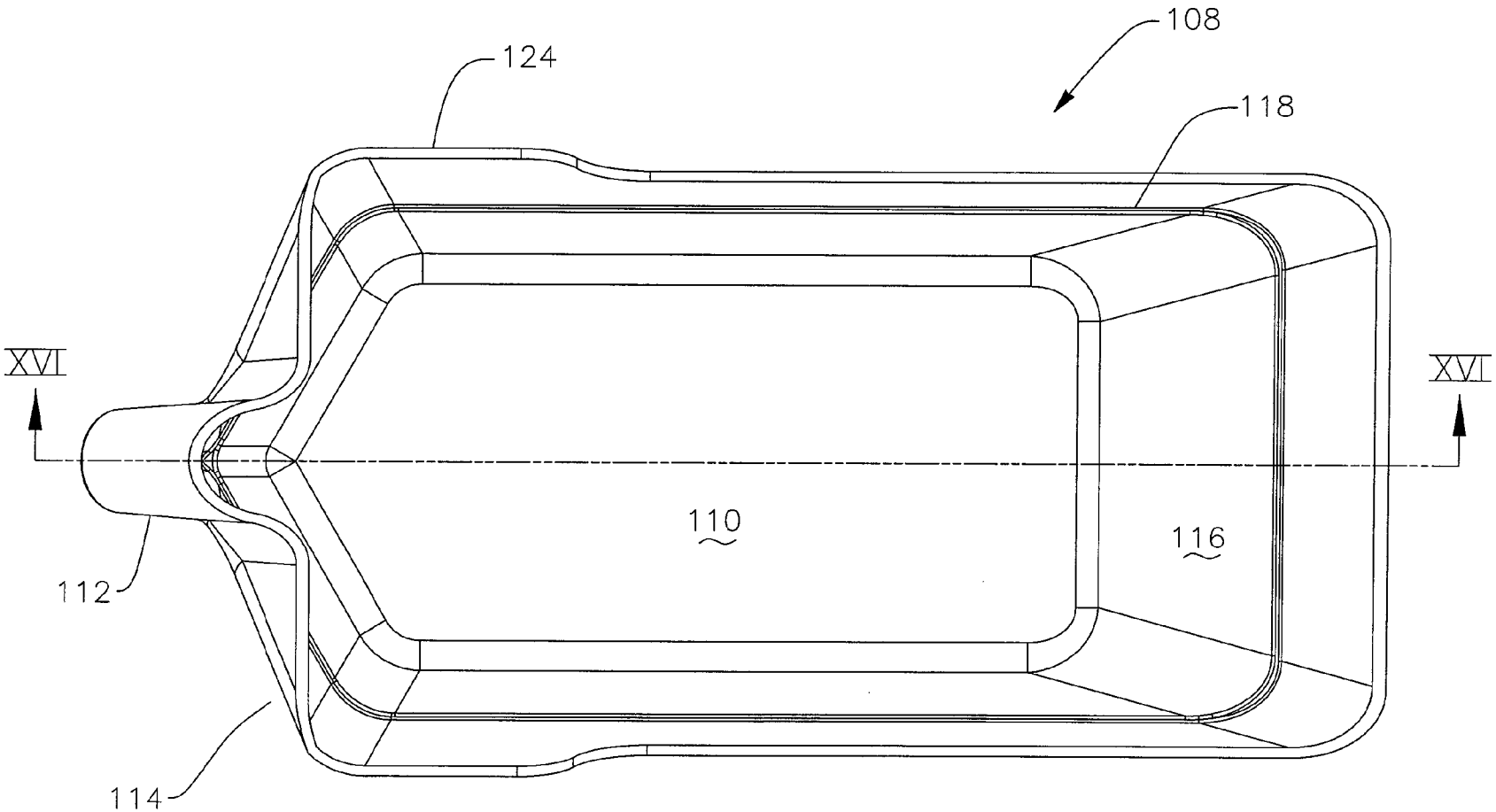
FIG. 15 is a top plan view of the trough of FIG. 13.
Figure 16:
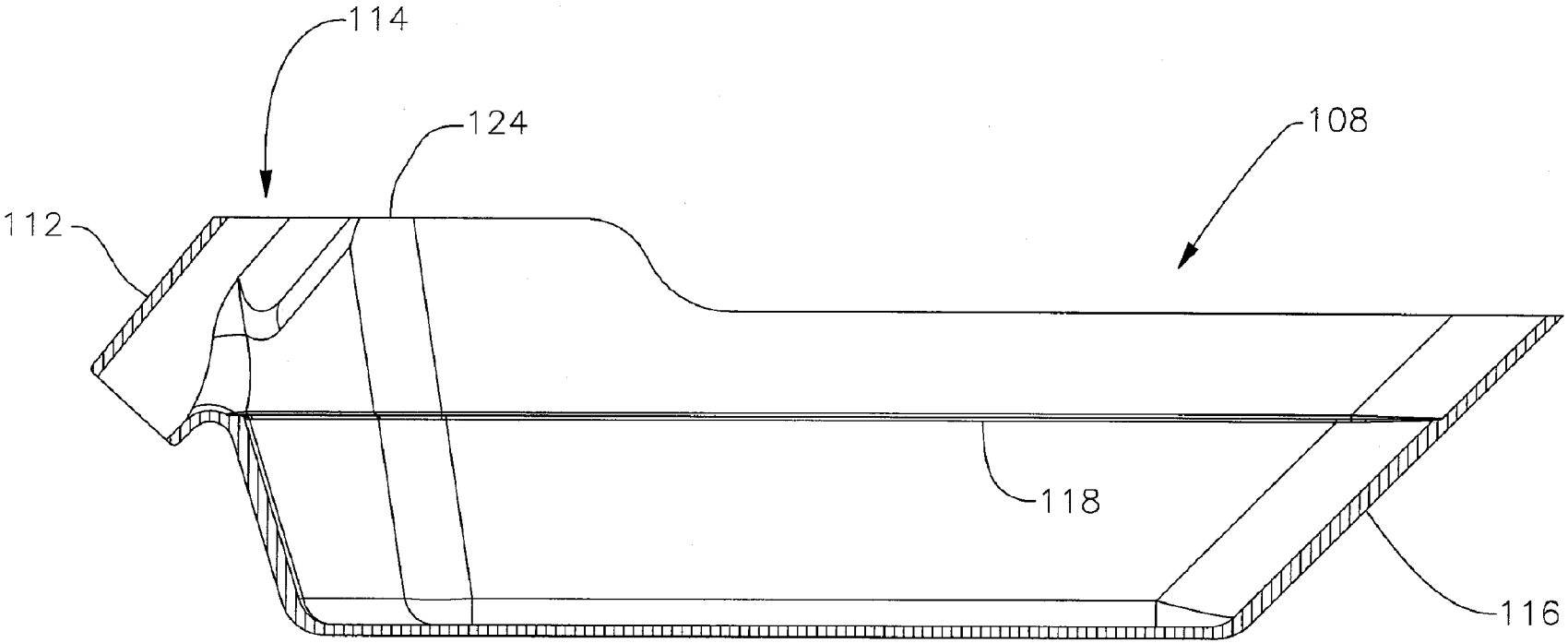
FIG. 16 is a section view taken along line XVI-XVI of FIG. 15.
Figure 17:
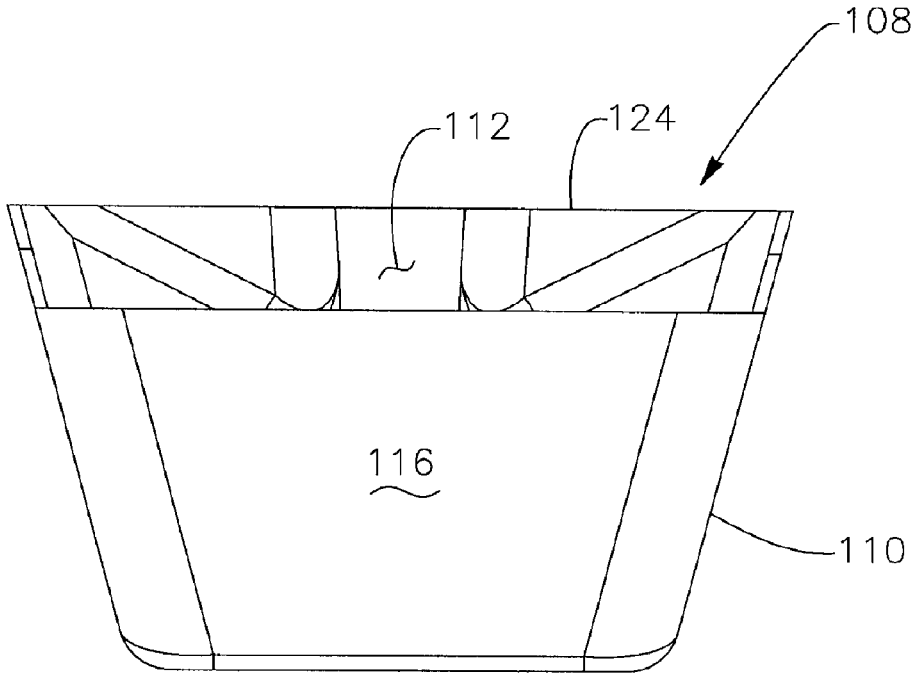
FIG. 17 is a rear elevation view of the trough of FIG. 13.
Figure 18:
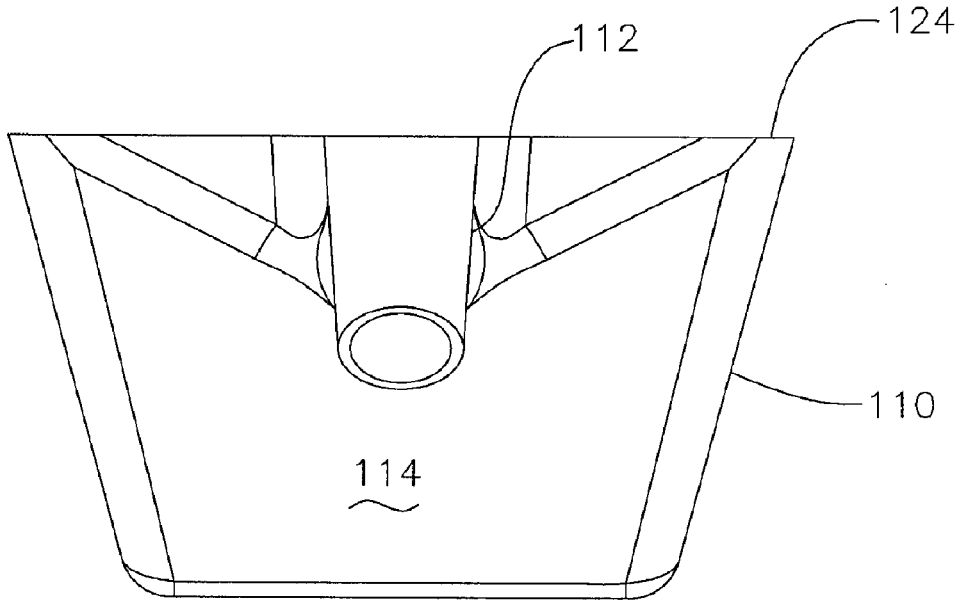
FIG. 18 is a front elevation view of the trough of FIG. 13.

Referring now most particularly to FIGS. 8-12, details of the construction and installation of the combined valve and O-ring making up seal 68 are shown. An O-ring portion 96 is similar to a conventional O-ring, except that it is attached to a peripheral rim 98 of the seal 68 as is a valve portion 100. FIGS. 8 and 11 show the valve portion 100 in its relaxed or CLOSED state, with a dome 102 forming a convex surface facing the O-ring portion 96. It is to be understood that FIG. 8 shows a section view of the combined valve and O-ring 68 along a line that is perpendicular to line XI-XI. Dome 102 has a slit 104 that is closed when the valve is in its relaxed state. Dashed line 102 shows the position the valve portion moves to when the valve is deformed to an OPEN state, as would occur when paint in the reservoir 46 is pressurized by squeezing the handle 22. In the OPEN state, valve 100 allows paint to flow from the reservoir 46 through the valve 100 to be delivered to the bristles 26, as indicated by arrows 106 in FIG. 3. It has been found desirable to lubricate the combined valve and O-ring 68 to assist in installing the O-ring portion 96 in groove 66 to avoid post installation residual stresses in the valve portion 100 which could otherwise adversely affect the operation of valve portion 100.

Referring now to FIGS. 13-18, various views of a paint loading device or trough 108 useful to fill the paint brush of the present invention may be seen. Trough 108 may include a generally rectangular body 110 with an integral spout 112 at a front end 114 thereof. A rear wall 116 may be sloped, to assist a user in both filling and emptying the trough 108 with respect to a conventional paint container, such as a one gallon (or other capacity) paint container in which paint is conventionally vended. Trough 108 may have a fill line 118 molded therein to assist a user in avoiding overfilling the trough 108. As shown, filling the trough 108 to the fill line 118 will provide enough paint in the trough 108 to fill the paint reservoir 46 twice. It is to be understood that an outside diameter 120 of the spout 112 is less than the inside diameter 122 of the first opening 48 of the paint reservoir 46, thus enabling a user to readily insert the spout 112 into the first opening 48 for conveniently and quickly delivering paint from the trough 108 to the paint reservoir 46 of the handle 22 without spilling. A raised wall portion 124 is provided at the front end 114 of the trough 108 to avoid spilling when the trough 108 is tipped to deliver paint to the reservoir 46.

To use the paint brush 20, a user will load the trough 108 with paint, remove the cap 50 from the first opening 48 of the paint reservoir 46 in the handle 22, and pour paint from the trough 108 into the paint reservoir 46 while the spout 112 is held within the first opening 48. Once the reservoir 46 is filled, the cap 50 is replaced. While the reservoir 46 is being filled the valve and O-ring 68 prevents paint from leaking out of the second opening 52 of the reservoir 46 via the siphon tube 54.

To load paint from the reservoir 46 to the bristles 26, the brush 20 is oriented as and if necessary to position a siphon tube inlet 126 within the paint held in the reservoir 46. As mentioned previously, the inlet 126 is positioned at a lowermost portion of the reservoir 46 when the brush 20 is held generally horizontally. The user then manually compresses or squeezes the reservoir causing paint to flow as indicated by arrows 106 in FIG. 3. It is to be understood that it is not necessary for the brush 20 to be positioned vertically (as illustrated in FIG. 3) to deliver paint to the bristles 26. The bristles 26 may be replenished with paint with the brush 20 held horizontally by the user.

In use, the paint brush 20 is intended to be grasped by a user with the handle 22 located between the user's thumb and one or more fingers on the same hand. A slightly concave depression may be formed on each side of the handle 22 to receive and position the thumb and forefinger, respectively.

When painting is completed, the brush head 24 may be separated from the handle 22 by simultaneously depressing the ears 82 and 84 until lips 86 are clear of engagement with apertures 76 on each side of the handle case halves 58, 60. The brush head 24 is then rotated about hook 74 until the brush head 24 is clear of the handle 22, at which time each may be cleaned by an appropriate solvent for the type of paint being used, e.g., water for a latex based coating, or mineral spirits for an oil based coating.

The invention is not to be taken as limited to all of the details thereof, as modifications and variations thereof may be made without departing from the spirit and scope of the invention.

The invention claimed is:

1. An internally fed paint brush comprising:

a brush head having a plurality of filaments and an internal passageway in fluid communication with the plurality of filaments, the internal passageway including a fluid inlet;

a handle that is removably connected to the brush head, the handle and brush head separable for cleaning;

a latching mechanism configured to retain and selectively release the brush head from the handle;

a reservoir and a siphon tube in the handle, the reservoir and siphon tube connected to draw paint from a lowermost region of the reservoir when the handle is generally horizontal and deliver paint to the brush head via the siphon tube and internal passageway of the brush head, the reservoir having an outlet and a fill opening, the siphon tube having a fluid outlet;

a seal disposed on the reservoir, between the fluid inlet of the internal passageway and the fluid outlet of the siphon tube;

a valve on the handle between the seal and the fluid outlet of the siphon tube, the valve opening when the reservoir is compressed and closing when the reservoir is not compressed; and a removable cap closing the fill opening, the fill opening providing fluid communication with the reservoir when the removable cap has been removed such that the reservoir can be filled with paint without removing the brush head from the handle;

wherein the seal and removable cap permit the handle to be removed from the brush head without spilling paint from within the reservoir.

2. The paint brush of claim 1 wherein the seal has an O-ring portion connected to the valve.

3. The paint brush of claim 1 further comprising a vacuum breaker valve to prevent vacuum in the reservoir as paint is delivered from the reservoir to the brush head.

4. The paint brush of claim 1 wherein the latching mechanism comprises at least one ear on one of the handle and brush head and at least one mating aperture on the other of the handle and brush head wherein when the ear is received in the aperture the brush head is retained to the handle, and when the ear is displaced from the aperture, the brush head is released from the handle.

5. The paint brush of claim 1 wherein the handle has a pair of concave depressions on opposite sides of the handle sized and positioned to receive a thumb and a forefinger of a user grasping the paint brush.

6. The paint brush of claim 1 wherein the handle further comprises a hook and the brush head further comprises a recess, the hook and recess in combination providing a pivoting connection between the handle and brush head that aligns the latching mechanism.

* * * * *